US012509187B2

(12) United States Patent
Cambria

(10) Patent No.: US 12,509,187 B2
(45) Date of Patent: Dec. 30, 2025

(54) SUBMERSIBLE STERN PLATFORM PROVIDED WITH OPENINGS FOR RECREATION

(71) Applicant: Luciana Christina Manfrinato Cambria, Curitiba (BR)

(72) Inventor: Filippo Cambria, Curitiba (BR)

(73) Assignee: Luciana Christina Manfrinato Cambria, Curitiba (BR)

( * ) Notice: Subject to any disclaimer, the term of this patent is extended or adjusted under 35 U.S.C. 154(b) by 852 days.

(21) Appl. No.: 17/636,711

(22) PCT Filed: Aug. 22, 2019

(86) PCT No.: PCT/BR2019/050346
§ 371 (c)(1),
(2) Date: Aug. 8, 2022

(87) PCT Pub. No.: WO2021/030883
PCT Pub. Date: Feb. 25, 2021

(65) Prior Publication Data
US 2022/0371689 A1 Nov. 24, 2022

(51) Int. Cl.
*B63B 3/46* (2006.01)
*B63B 29/02* (2006.01)
*B63B 29/04* (2006.01)

(52) U.S. Cl.
CPC ..... *B63B 3/46* (2013.01); *B63B 29/04* (2013.01); *B63B 2029/022* (2013.01); *B63B 2029/043* (2013.01)

(58) Field of Classification Search
CPC ..... B63B 29/04; B63B 2029/022; B63B 2029/043; B63B 27/14; B63B 27/143; B63B 25/18; B63B 25/28; B63B 3/46
USPC ..... 114/343, 362, 364
See application file for complete search history.

(56) References Cited

U.S. PATENT DOCUMENTS

| | | | | |
|---|---|---|---|---|
| 4,824,067 | A * | 4/1989 | O'Brien | B63H 20/10 248/642 |
| 5,076,188 | A | 12/1991 | Burroughs | |
| 5,113,791 | A * | 5/1992 | Rottschafer | B63H 20/36 248/642 |
| 7,162,969 | B2 | 1/2007 | Houlder et al. | |
| 7,707,955 | B1 | 5/2010 | Johns, Jr. | |
| 8,375,880 | B1 | 2/2013 | Callan | |

(Continued)

FOREIGN PATENT DOCUMENTS

| | | |
|---|---|---|
| BR | 112017027857 | 8/2018 |
| EP | 0253745 | 1/1988 |

(Continued)

OTHER PUBLICATIONS

English Translation of Brazilian International Search Report mailed Jul. 4, 2020, for PCT/BR19/50346, 4 pages.

*Primary Examiner* — Daniel V Venne
(74) *Attorney, Agent, or Firm* — Morgan, Lewis & Bockius, LLP

(57) ABSTRACT

The present invention relates to a submersible stern platform (100) equipped with openings for recreation, comprising an opening (150), one or more secondary openings (160) preferably arranged along the vicinity of the opening (150), the opening (150) being reversibly closed by a gate (151) and the secondary openings (160) being reversibly closed by one or more secondary gates (161).

6 Claims, 7 Drawing Sheets

(56) References Cited

U.S. PATENT DOCUMENTS

| | | | | |
|---|---|---|---|---|
| 9,114,857 | B2 * | 8/2015 | Miller | ..... B63B 27/146 |
| 2018/0354589 | A1 | 12/2018 | Wood | |

FOREIGN PATENT DOCUMENTS

| | | | |
|---|---|---|---|
| IT | SP20 100 007 | A1 | 5/2012 |
| WO | WO 2011137548 | A2 | 11/2011 |
| WO | WO 2014199314 | A2 | 12/2014 |
| WO | WO 2016207693 | A1 | 12/2016 |

* cited by examiner

SUBMERSIBLE STERN PLATFORM PROVIDED WITH OPENINGS FOR RECREATION

FIELD OF APPLICATION

The present invention belongs to the field of mechanical and nautical engineering, as well as architecture, more specifically of reservoirs, tanks, swimming pools, bathtubs, and the like intended for use on vessels.

INTRODUCTION

The present invention relates to a submersible stern platform provided with openings for recreation, comprising a gate and, optionally, backrest elements and components capable of forming an open, partially open or closed reservoir, equipped with a bottom and/or supports for supporting feet.

BACKGROUND

Submersible stern platforms are widely used on vessels for various purposes, including assisting in the entry and exit of water, forming small platforms for bathing, using cooking equipment, assisting in launching, collecting or raising accessories, diving tanks and even other smaller vessels, among other applications.

As swimming pools and other recreational and leisure elements are also highly appreciated on vessels, especially on speedboats, yachts, and the like, there are several devices and systems that form reservoirs to be filled with water.

These devices can be inflatable or fixed, but they are always part of an additional device that either requires a relatively high effort to assemble and/or requires complex moving and concealing systems.

STATE OF THE ART

Examples of solutions of this nature are described, for example, by the patent document BR112017027857 of title "boat with a movable stern hatch, having a submersible stern platform", which discloses, according to the abstract, a boat comprising a hull provided with a rear stern hatch, located in correspondence with an stern internal compartment of said hull, suitable for opening and closing a respective opening of said compartment, said hatch having a body with opposite sides, located in correspondence with side walls of said compartment, and an upper edge and a lower edge, and said hull having a stern platform which is movable and submersible. Instead of being provided with direct connections to the hull, the hatch is connected to the stern platform in order to reach, after the opening, a submerged position in the water where the boat is located, at the moment when said platform submerges in said water.

The solution proposed by BR112017027857 is ingenious and interesting, as it provides a submersible bow platform with direct access to the interior of the boat, however it does not provide a platform with additional recreation options such as an opening with a gate and neither backrest elements nor a bottom to support the feet.

Another relevant prior art document is patent number U.S. Pat. No. 7,162,969 which reveals a platform seated on the stern of a boat hull and which can be lowered by means of motorized drive by guides at a certain slope, to descend into the water, which exposes steps to allow a swimmer to leave the water and reach the main deck of the boat. This solution, although ingenious, also does not provide an opening with a gate that allows leisure and recreation activities on the platform.

US 2018/0354589 discloses a swimming platform for attachment to a boat that includes a rearwardly tapered inflatable body, including an upper surface capable of supporting a standing person, an external perimeter including a front wall, a rear wall and a side wall extending between the front wall and the stern wall. This swimming platform can be left in the water while the boat is in motion. This proposal offers a recreation option, however it is external to the boat, demands a certain effort for its use, and even when deflated takes up considerable space on the vessel.

The patent document EP0253745 refers to an attached service system connected to a ship, which has a floating part that comprises a platform element intended to be horizontal in the active position, mounted on a float articulated to the platform element in order to be relatively mobile with respect to the platform element under the effect of the sea movement, the platform element being coupled to the boat by a coupling device forming at least one parallelogram articulated in a vertical plane. This solution applies, in particular, to a swimming pool or transshipment platform, but it has the same disadvantages as the solution described above, in particular the fact that it occupies precious space on the vessel and involves a complex and expensive system of articulations and drives.

As can be inferred from the previous descriptions, there is space for a submersible stern platform equipped with openings for recreation capable of overcoming the drawbacks of the state of the art described above, in particular providing an opening comprising a gate and, optionally, backrest elements and components capable of forming an open, partially open or closed reservoir, equipped with a bottom and/or supports to support feet.

Objectives of the Invention

The objective of the present invention is, therefore, to provide a submersible stern platform. In some embodiments, the submersible stern platform is equipped with recreational openings, characterized in that it comprises an opening, one or more secondary openings preferably arranged along the vicinity of the opening, the opening being reversibly closed by a gate and the secondary openings being reversibly closed by one or more secondary gates.

In some embodiments, the submersible stern platform is characterized in that the gates are closing elements that can be fitted and raised manually and/or by sliding and retracting it into niches, that are divided into one or more parts and/or as a single piece and/or foldable and/or foldable divided into one or more and/or in a combination of these options, in any configuration and construction suitable for opening and closing or retracting the opening.

In some embodiments, the submersible stern platform is characterized in that the secondary gates reversibly cover the secondary openings and that, once removed, together or separately, allow the insertion of one or more abutment elements.

In some embodiments, the submersible stern platform is characterized in that the platform comprises a seating region.

In some embodiments, the submersible stern platform is characterized in that the abutment elements are reversibly fixed to the secondary openings, and may contain hydromassage nozzle, heating, cooling, back massage elements, lighting, speakers, and the like.

In some embodiments, the submersible stern platform is characterized in that it may further comprise bottom elements that are movable or removable elements, totally closed or equipped with total or partial openings, also comprising drains, nets, meshes, glasses and other safety and/or decoration or leisure elements, such as hydromassage, heating, cooling, foot massagers, lighting, speakers, and the like.

In some embodiments, the submersible stern platform is characterized in that the movement of the gates, the abutments, and the bottom elements is done by manual traction, gears, spindles, levers, ratchets, and the like, electric, hydraulic or pneumatic engines, gravitational systems, capillary and/or communicating vessel systems, alone or in combination.

In some embodiments, the submersible stern platform is characterized in that the activation of the gates, the abutments and the bottom elements is independent, and can be wired, wireless, via bluetooth, radiofrequency, cellular network, internet, ultrasound, magnetically or by any suitable means.

In some embodiments, the submersible stern platform is characterized in that the gates, the abutments and the bottom elements of the platform have, in addition, pipes and built-in wiring.

In some embodiments, the submersible stern platform is characterized in that the gate can be used as an abutment.

BRIEF DESCRIPTION OF THE FIGURES

For better understanding and visualization of the subject matter, the present invention will now be described with reference to the appended figures, representing the obtained technical effect through exemplary embodiments without limiting the scope of the present invention, in which.

DETAILED DESCRIPTION OF THE INVENTION

Figure 1:
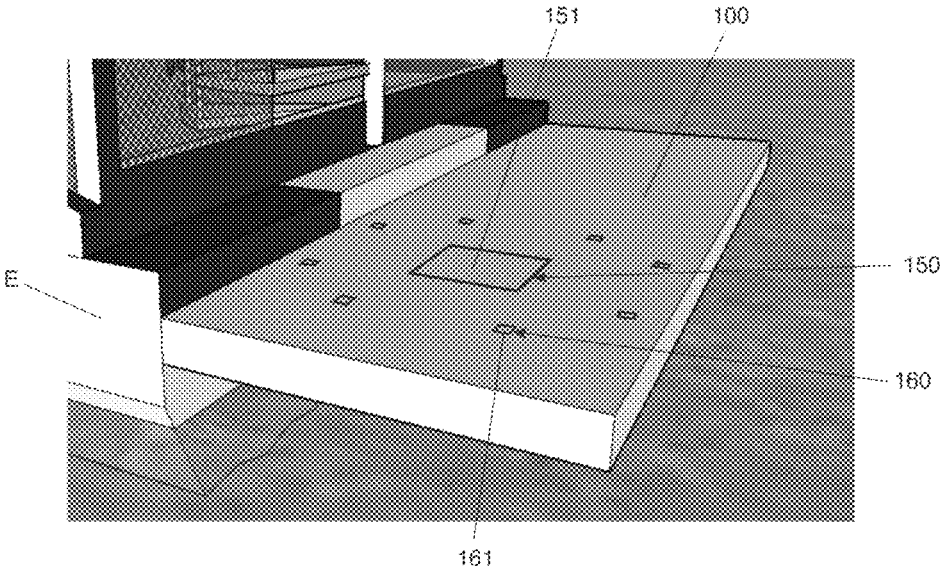
FIG. 1: presents a partial perspective view of a vessel equipped with a platform according to the invention, showing its elements in a retracted or closed position.
Figure 2:
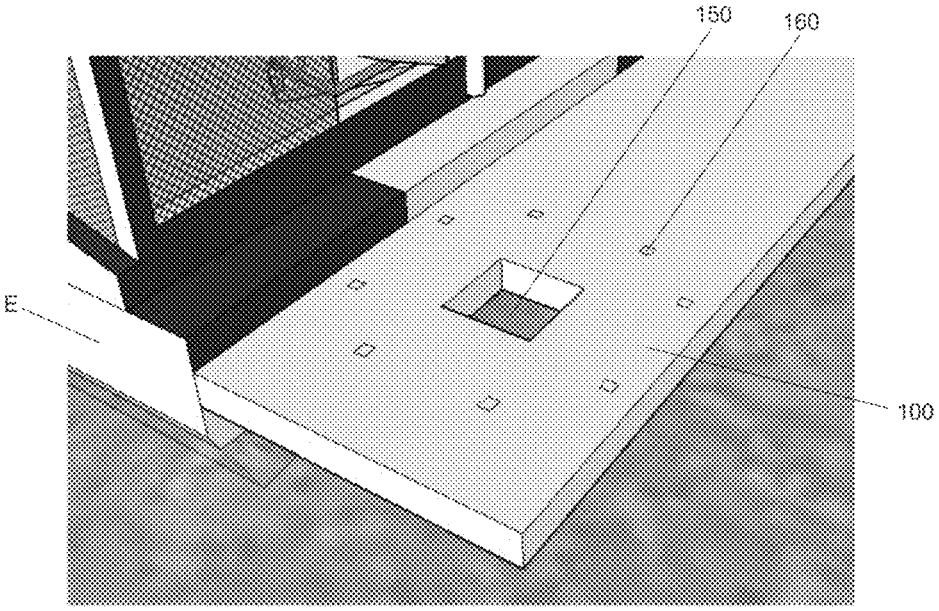
FIG. 2: presents a partial perspective view of the vessel of FIG. 1, showing the openings after removing the gates.
Figure 3:
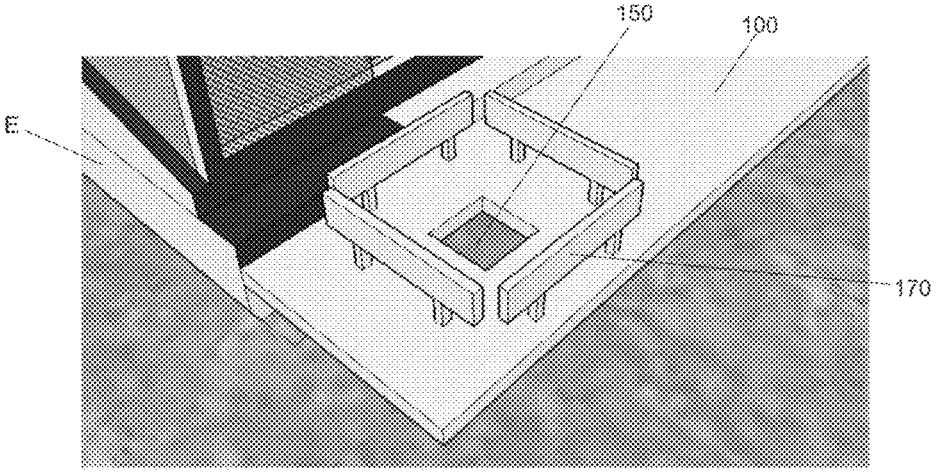
FIG. 3: presents a partial perspective view of the vessel of FIG. 1, showing the backrest elements mounted on the secondary openings.
Figure 4:
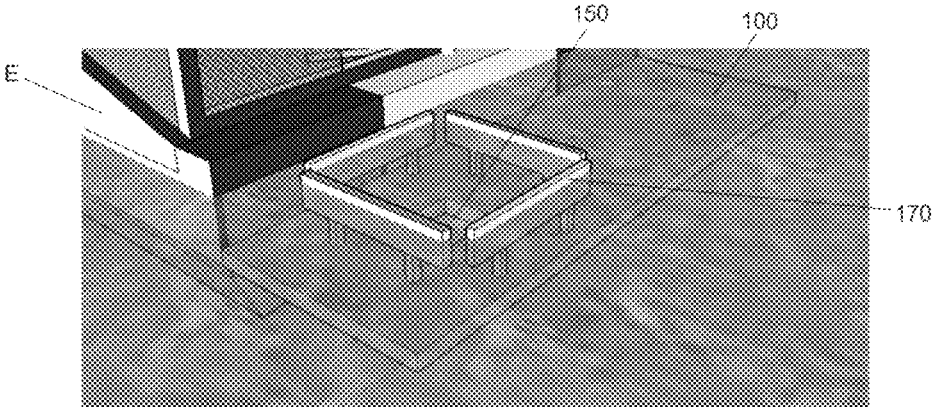
FIG. 4: presents the platform of FIG. 3, with the partially submerged elements.

A submersible stern platform (100) or simply platform (100), according to the invention, comprises an opening (150) arranged in any position on the platform, one or more secondary openings (160) preferably arranged along the proximities of the opening (150), the opening (150) being reversibly closed by a gate (151) and the secondary openings (160) being reversibly closed by one or more secondary gates (161).

Figure 6:
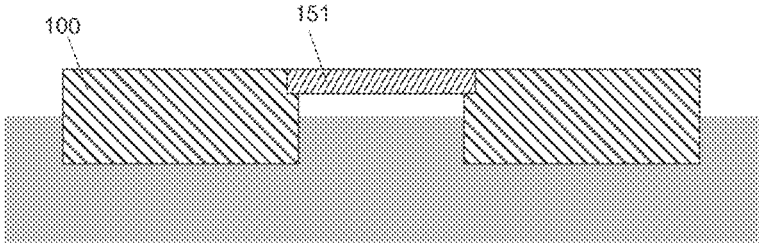
FIG. 6: presents a back view in partial section of a platform according to the invention, equipped with a raisable gate.
Figure 7:
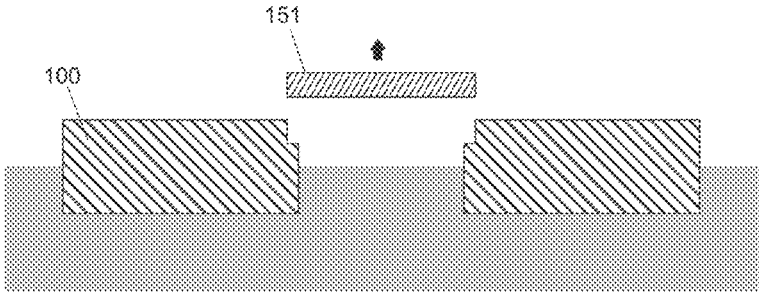
FIG. 7: presents the gate of FIG. 6 being raised and clearing the opening.
Figure 8:
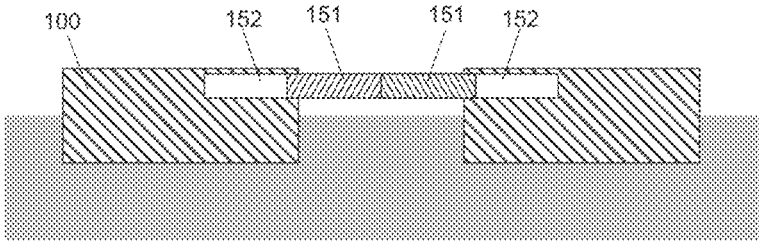
FIG. 8: presents a back view in partial section of a platform according to the invention, equipped with a divided sliding gate.
Figure 9:
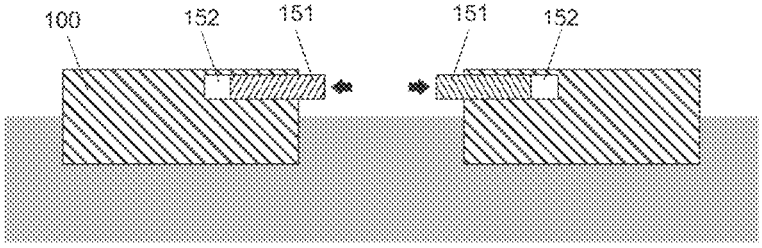
FIG. 9: presents the gate of FIG. 8 being slid into the niches.
Figure 10:
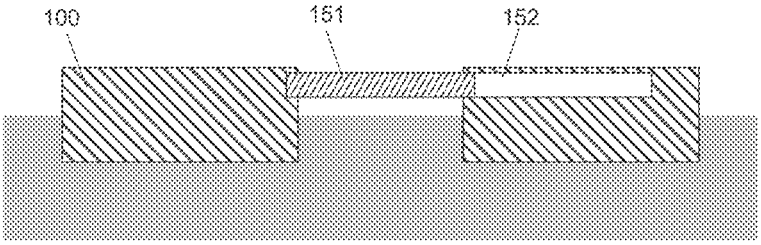
FIG. 10: presents a back view in partial section of a platform according to the invention, equipped with a single sliding gate.
Figure 11:
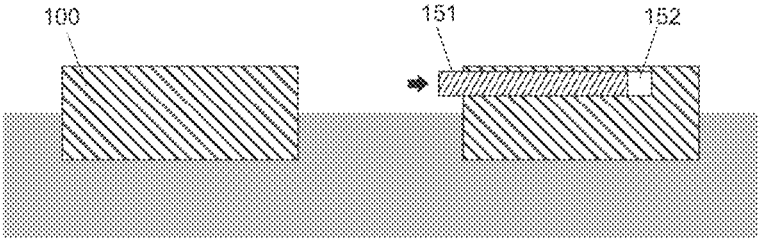
FIG. 11: presents the gate of FIG. 10 being slid into the niches.
Figure 12:
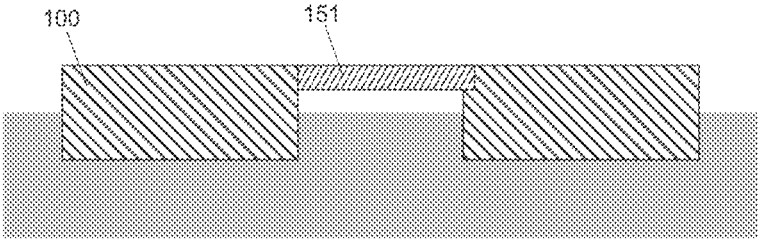
FIG. 12: presents a back view in partial section of a platform according to the invention, equipped with a pivoting or folding gate.
Figure 13:
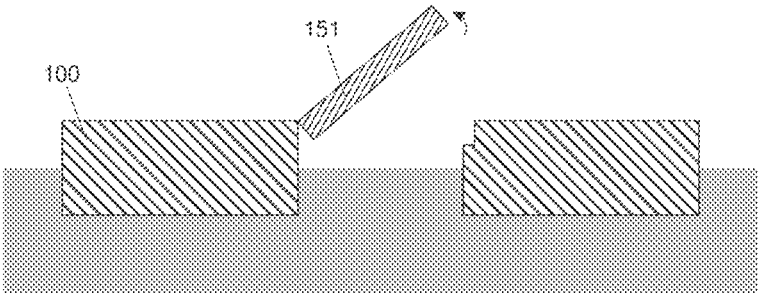
FIG. 13 presents the gate of FIG. 12 being opened by pivoting.
Figure 14:
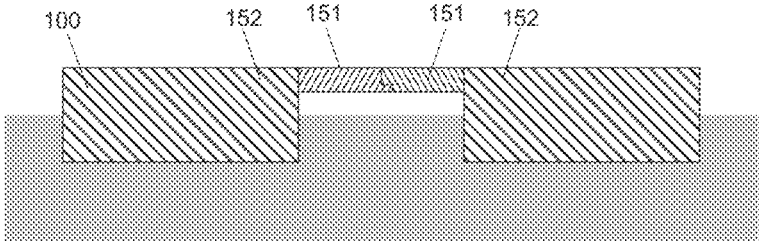
FIG. 14: presents a back view in partial section of a platform according to the invention, equipped with a divided pivoting or folding gate.
Figure 15:
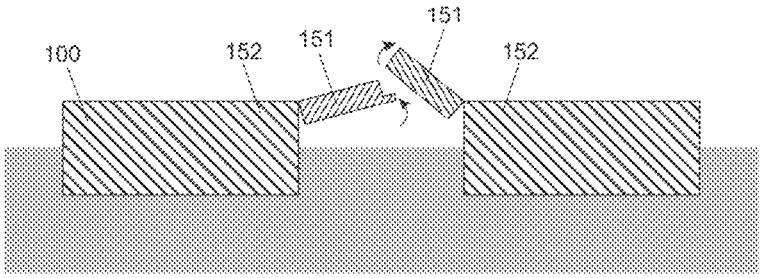
FIG. 15: presents the gate of FIG. 14 being opened by pivoting.
Figure 16:
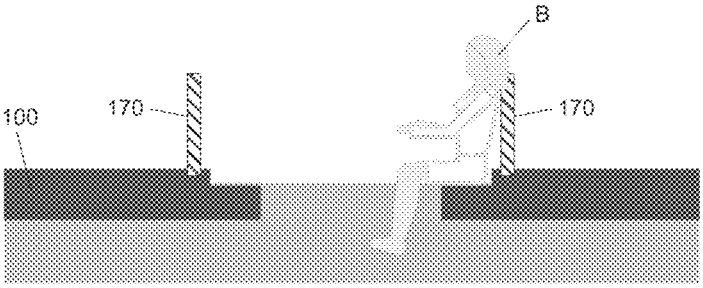
FIG. 16: presents a back view in partial section of a platform according to the invention, showing the situation of use with the removed gate, without a bottom, and with a backrest element.
Figure 17:
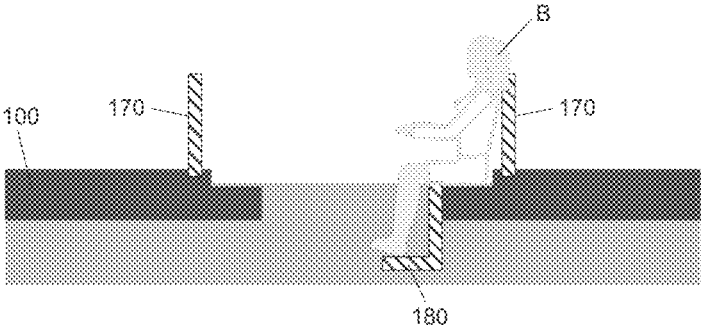
FIG. 17: presents a back view in partial section of a platform according to the invention, showing the situation of use with the gate removed, a bottom in the form of a footrest and a backrest element.
Figure 18:
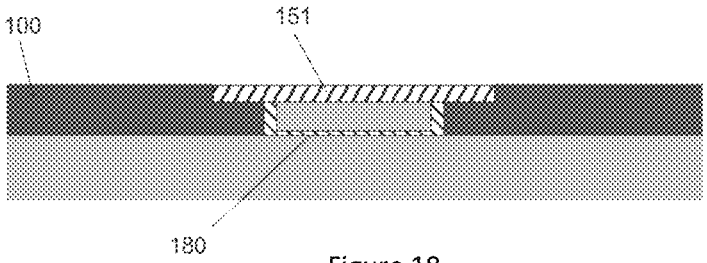
FIG. 18: presents a back view in partial section of a platform according to the invention, equipped with a gate, and a built-in and movable bottom.
Figure 19:
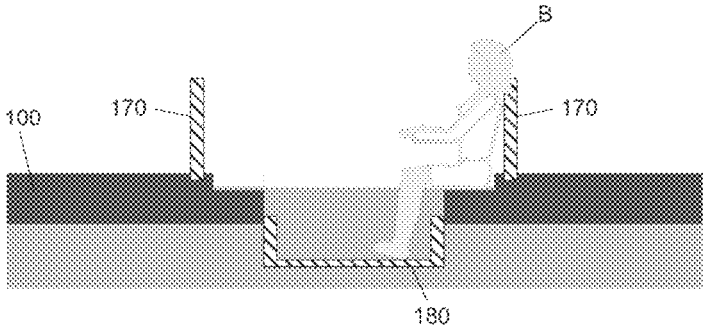
FIG. 19: presents the platform of FIG. 18 with the gate removed, the backrests elements fitted, and the bottom partially extended.
Figure 20:
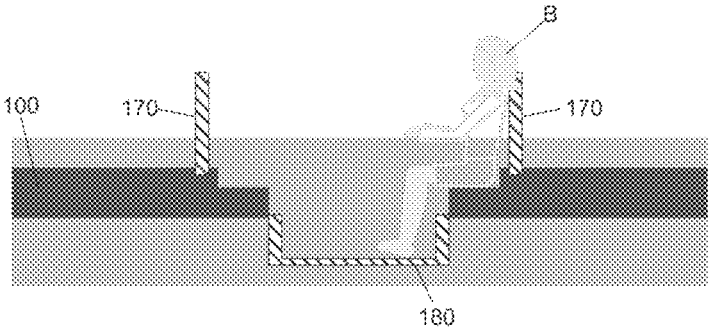
FIG. 20: presents the platform of FIG. 18 with the gate removed, the backrests elements fitted, and the bottom fully extended.

The gate (151) of the invention is a suitable closing element that acts as a gate, which can be fitted and raised manually (FIGS. 6 and 7) and/or by sliding and retracting it into niches (152), that is divided into one or more parts (FIGS. 8 and 9) and/or as a single piece (FIGS. 10 and 11) and/or foldable (FIGS. 12 and 13) and/or foldable divided into one or more (14 and 15) and/or a combination of these options, in any suitable configuration and construction for opening and closing or retracting the opening (150).

Once the gate (151) is removed, a vast range of possibilities for use and activities, and also for accessories opens up, significantly expanding the possibilities of taking advantage of a platform (100) of the nature discussed here.

The above considerations also apply to the secondary gates (161) which reversibly cover the secondary openings (160) and which, once removed, together or separately, allow the insertion of various accessories, but, in particular, of one or more backrest elements (170).

The shape of the openings (150) and of the secondary openings (160) and, therefore, of their respective gates (160) and secondary gates (161), can have any shape, including, in a non-limiting way, polygonal, round, oval, oblong, and the like.

In some embodiments of the invention, the platform (100) has only one opening (150) and no secondary opening (160) and thus no secondary gate (161). In this case, the backrest elements (170) and other accessories are properly fixed to the platform, for example, by means of suction cups, lashings, straps, and the like.

In some embodiments of the invention, the platform (100) has an opening (150) and one or more secondary openings (160) without any secondary gate (161), thus remaining permanently open.

Figure 5:
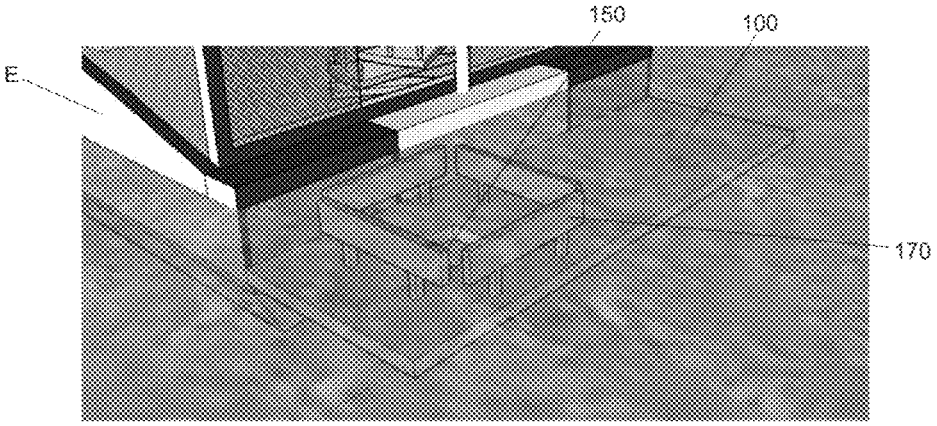
FIG. 5: presents the platform of FIG. 3, with the elements fully submerged.
Figure 5A:
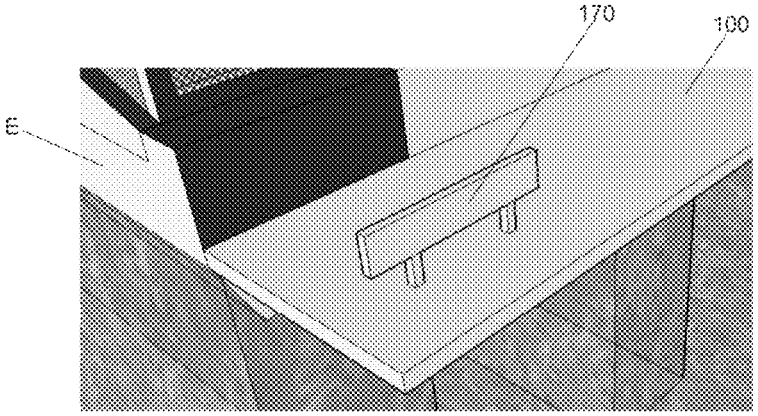
FIG. 5*a*: presents an embodiment of the platform according to the invention equipped only with backrest element.

In some embodiments of the invention, the platform (100) has no opening (150) and only one or more secondary openings (160) and/or secondary gates (161) for fixing one or more backrest elements (170), as shown in FIG. 5*a*.

Figure 5B:
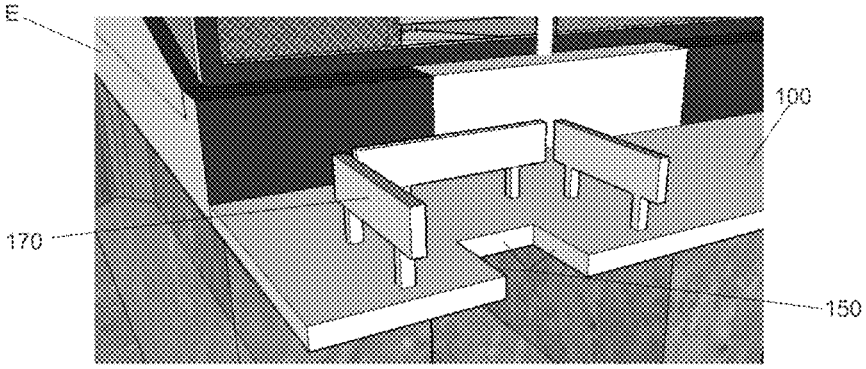
FIG. 5*b*: presents one of the possibilities for arranging the platform elements according to the invention.

It should be noted that all elements of the platform (100) according to the invention can be located in any position, order, or alignment, as demonstrated also by the configuration of FIG. 5*b*.

It should be noted that it is also possible to use the gate (151) itself as a backrest element.

In general, the platform (100) comprises a seat region (101), the backrest elements (170) and, eventually, bottom elements (180).

The backrest elements (170) are able to be reversibly fixed to the secondary openings (160) and can contain hydromassage, heating, cooling, back massage elements, lighting, speakers, and the like, considering that once submerged, total or partially, there is no longer any need for seals or other watertightness elements for the operation of a hydromassage. In addition, the water in which the vessel is sailing can be used.

The bottom elements (180), in turn, when present, are also mobile or removable elements, and can be fully closed or equipped with total or partial openings, including drains, nets, meshes, glasses and other safety and/or decoration or leisure elements, such as hydromassage, heating, cooling, foot massagers, lighting, speakers, and the like.

The positional combinations provide a platform (100) capable of serving as a seating or recreation place, with or without water and depending on the size of the project, the platform (100) according to the invention can serve as a beach, swimming pool, bathtub, opening for fishing, water collection, and other possibilities.

It should be noted that the platform (100) can also comprise complementary elements such as covers, drains, grids, meshes or a combination of these options, according to the desired application.

The movement of the gates (151, 161), the backrest elements (170), and the bottom elements (180) is possible by means of any suitable traction device. Suitable traction devices are, but not limited to, manual traction, gears, spindles, levers, ratchets, and the like, electric, hydraulic or pneumatic engines, gravitational systems, capillary and/or communicating vessel systems and any others that are suitable for the vessel and the conditions of use and application, alone or possibly in combination.

Actuation of the gates (151, 161), of the backrest elements (170) and of the bottom elements (180) is, appropriately, equally independent, and can be accomplished by wire, wireless, via bluetooth, radiofrequency, cellular network, internet, ultrasound, magnetically or by any suitable means.

Whether hollow or solid or combined, the gates (151, 161), the backrest elements (170), and the bottom elements (180) of the platform (100) may have pipes and wiring built in, enabling direct internal or indirect external installation of pumps and nozzles for hydromassage, lighting, massagers, heating, cooling, etc.

It is important to note that, depending on the intended application, the platform elements may need seals between their contact and/or sliding walls and surfaces.

ADDITIONAL BENEFITS AND DESCRIPTIONS

The person skilled in the art will understand that the platform (100) according to the invention solves several problems of the state of the art, providing a submersible stern platform equipped with openings for recreation capable of overcoming the drawbacks of the state of the art described above, in particular comprising an opening equipped with a gate and, optionally, backrest elements (170) and components capable of forming an open, partially open or closed reservoir, provided with a bottom (180) and/or supports to support feet.

CONCLUSION

The present invention, therefore, provides a platform (100) which, together with the aforementioned dimensions and characteristics, provides new and inventive solutions to problems in the state of the art of stern platforms (100) and the like.

Final Remarks

It will be easily understood by those skilled in the art that modifications can be made to the present invention without departing from the concepts set out in the description above. Such modifications should be considered as comprised by the scope of the present invention. Consequently, the particular embodiments described in detail above are only illustrative and exemplary, and do not limit the scope of the present invention, which should be given the full extent of the appended claims and any and all equivalents thereof.

What is claimed:

1. A submersible stern platform equipped with recreational openings, wherein the submersible stern platform comprises an opening, one or more secondary openings arranged along a vicinity of the opening, the opening being reversibly closed by a gate and the one or more secondary openings being reversibly closed by one or more secondary gates, and wherein the opening forms a reservoir configured to be open, partially open, or closed by the gate, and the one or more secondary openings is reversibly covered by the one or more secondary gates, wherein the one or more secondary gates, once removed, together or separately, allow the insertion of one or more backrest elements in the one or more secondary openings, and wherein the submersible stern platform comprises a seating region between the opening and the backrest elements.

2. The submersible stern platform according to claim 1, characterized in that the gate and the one or more secondary gates are closing elements fitted and raised manually or by sliding and retracting the gate and the one or more secondary gates into niches that are divided into one or more parts or a single piece that is foldable or foldable divided, or a combination thereof, in any configuration and construction suitable for opening and closing or retracting the opening.

3. The submersible stern platform according to claim 1, characterized in that the one or more backrest elements are reversibly fixed to the one or more secondary openings.

4. The submersible stern platform according to claim 1, characterized in that the submersible stern platform further comprises bottom elements that are movable or removable elements, totally closed or equipped with total or partial openings.

5. The submersible stern platform according to claim 4, characterized in that activation of the gate and the one or more secondary gates, the one or more backrest elements and the bottom elements is independent.

6. The submersible stern platform according to claim 1, characterized in that the gate can be used as a backrest.

* * * * *